United States Patent [19]

Williamson

[11] 4,066,076

[45] Jan. 3, 1978

[54] REBREATHABLE GAS MIXING AND CONTROL DEVICE

[76] Inventor: Larry H. Williamson, 18232 Santa Sophia, Fountain Valley, Calif. 92708

[21] Appl. No.: 721,966

[22] Filed: Sept. 10, 1976

[51] Int. Cl.[2] ..... A62B 7/00

[52] U.S. Cl. ..... 128/142.2; 128/210; 137/114

[58] Field of Search ..... 128/142.2, 142 R, 142.3, 128/145.8, 146.5, 147, 203, 191 R, 209, 210; 137/114

[56] References Cited

U.S. PATENT DOCUMENTS 3,526,239 9/1970 Oroza ..... 128/142.2

3,805,780 4/1974 Cramer et al. ..... 128/142.2

*Primary Examiner*—Dalton L. Truluck
*Assistant Examiner*—Henry J. Recla
*Attorney, Agent, or Firm*—Harold C. Weston

[57] ABSTRACT

A life support system providing breathable gas from a high pressure source utilizes an exhaled gas treatment device to eliminate harmful components from exhaled gas and incorporates a novel rebreathable gas mixing and supply device in which inhalation pressure of the user activates a fresh breathable gas supply valve which, in turn, jets the fresh breathable gas into and through a mixing chamber, providing a booster type suction force to pull exhaled gas through the treatment device, mixing the treated, purified gas with the fresh gas and supplying the resultant mixture to the user.

9 Claims, 2 Drawing Figures

$CO_2$ FILTER

AIR
AIR
$CO_2$ FILTER

REBREATHABLE GAS MIXING AND CONTROL DEVICE

BACKGROUND OF THE INVENTION

1. Field of the Invention

This invention relates to life support systems equipment, and, more particularly, to an equipment array utilizing an improved Bernoulli effect tube arrangement to reduce exhalation pressure on the user while saving his exhaled gas for reuse after "scrubbing" out its carbon dioxide ($CO_2$) contaminants.

Sport diving, fishing, oil rig maintenance and a variety of land search and rescue operations, in contaminated environments, require a person to carry his own supply of breathable gas into a hostile environment of operation. Present day systems generally rely on bulky cylinders of breathable gas with manually controlled supply valves which require constant attention from the user, and these systems are of such a nature that the exhaled gas of the user is exhausted directly from the lungs of the user into the adjacent environment, severely limiting "stay time" in that environment through the mass and bulk limits of stored breathable gas capable of being carried by him.

The device herein described will be presented in a discussion utilizing compressed air as the breathable gas being considered, but combinations of pure oxygen, oxygen/helium or oxygen augmented air are suitable substitutes wherever "breathable gas" is used in the discussion. It provides for safe, more efficient use of the "fresh" breathable gas by having it act as a forcing means to pull exhaled gas through a $CO_2$ filter rendering the residual oxygen of that exhaled gas useable by the system operator when it is enriched with fresh breathables. As a direct consequence of this use of exhaled gas, stay time in the operational environment is greatly extended for a given quantity of stored, fresh, breathable gas.

2. Description of the Prior Art.

Nominal composition of air at sea level and under standard atmospheric conditions is approximately 20% oxygen and 80% inert gases or elements not useable in the body's metabolic processes. Upon inhalation, air passes through a person's lungs, oxygenating the body's blood supply for transport of that oxygen to the organs and tissues requiring the blood's nutrients and oxygen. Exhalation of the air breathed produces a mixture in which approximately 20% of the original oxygen of the air has been converted to carbon dioxide so that this exhausted air's composition is roughly 4% carbon dioxide, 80% inert elements and 16% oxygen.

Since oxygen is the component required for the body's metabolic processes, this exhaust air has considerable metabolic value remaining and so has corresponding value to the user. As described in U.S. Pat. Nos. 3,016,053 and 3,021,839, certain systems have been designed to salvage this useable oxygen in rebreathable gas storage systems and the invention described herein provides significant improvement over such systems.

The rebreathable gas storage systems of the referenced patents operate in a semi closed circuit arrangement wherein the user exhales directly into a $CO_2$ scrubber which removes that contaminant and passes the purefied mixture to a storage reservoir. Pressure used to force the gas through the scrubber is provided by the user in muscular contraction of his chest and so forcing flow of the mixture from his lungs through the scrubber and into the reservoir. From the storage reservoir, the rebreathed gas is enriched with higher oxygen content unused or "fresh" breathable gas from a storage source, breathed by the user, and the cycle repeated.

Typical SCUBA (self contained underwater breathing apparatus) systems employ stored breathables in high compression cylinders carried by the diver or user. With standard manual control valves, the diver can set the pressure of his first stage regulator and manually open or close the stored breathables supply to breathing parts of his equipment. In use, his inhalation provides breathables through a check valve and, upon satisfaction of his oxygen intake requirements, the diver exhales through a second check valve, exhausting the breathed gases into the surrounding environment. This type of system is known as an "open circuit"0 system, where there is no circulation of gases. Breathables are consumed from the supply and exhausted directly into the surrounding environment. This same type of breathing system is used in surface rescue systems employing different types of breathing ports, face masks, etc. It is well recognized that while the open circuit system is the safest and simplest of breathable gas systems, it is also the most inefficient, in that approximately 80% of the oxygen value in the stored breathables is wasted upon its exhaust to the ambient environment. (Reference U.S. Pat. No. 3,021,839, column 1, lines 29 through 49)

Advantages and disadvantages of closed circuit systems fully utilizing the breathed gases of the user are described in the referenced patents as well as the "semi-closed circuit" system proposed as the invention therein.

The within invention incorporates the efficiencies of the above "semi closed circuit" system by recirculation of breathed gases for salvage of their high oxygen content, but improves significantly thereon by using the flow of high pressure fresh breathables to boost the recirculated gas through its treatment apparatus, (actually a $CO_2$ filter or absorbent purifier) relieving the user from the task of forcing the breathed gases through it with his lung power on exhalation. The invention operates in what is described as "semi open circuit" mode because the user exhausts his lungs into a receiver which is at the pressure of the outside environment, much as in the open circuit mode, but he preserves the exhalation gases for reuse, exhausting the excess to the environment. (The "excess" being that amount of breathed gas not pulled through the treatment apparatus. This amount, or fraction, in turn, being determined by design of the jet and breathing tube described in the attached specification.)

Novelty and utility of the device proposed herein rest in its ability to provide energy from the stored supply of fresh breathable gas to "force" exhaled gas through a $CO_2$ scrubber/filter for reuse by the system operator with augmentation of that exhaled and purified gas by fresh breathable material from the "forcing" gas itself. The energy used for pulling exhaled gas through the scrubber/filter is so supplied by the oxygen enriching supply gas of the system rather than by lungs and muscles of the user as in other life support systems utilizing rebreathable gas.

OBJECTS OF THE INVENTION

Accordingly it is an objective of the present invention to provide an improved life support system utilizing rebreathable gas in a semi open circuit system through incorporation of a novel rebreathable gas mixing and supply device wherein stored, high pressure fresh breathable gas is utilized to force, exhaled gas through an apparatus for treating breathed gases, which is, typically, a scrubber/purifier unit for removal of $CO_2$ poisons therefrom.

Another object of the invention is to provide a safe, self contained underwater breathing apparatus for use in a semi open circuit mode which increases "stay time" underwater for fixed capacity storage tanks and with automatic, depth compensating, demand/supply provision of breathable gas.

Still another object of this invention is to provide a significantly lighter land rescue breathing gas system with extended use time in a contaminated environment, utilizing rebreathable gas.

A further objective of this invention is to enconomize on expensive oxygen/helium or pure oxygen systems utilizing surface supply storage or breathables which are pumped to divers during underwater operations.

A still further object of this invention is to provide a breathing system of the rebreathable air type in which the effort to inhale is far less than that required of other units of this type.

DETAILED DESCRIPTION OF THE INVENTION

Figure 1:
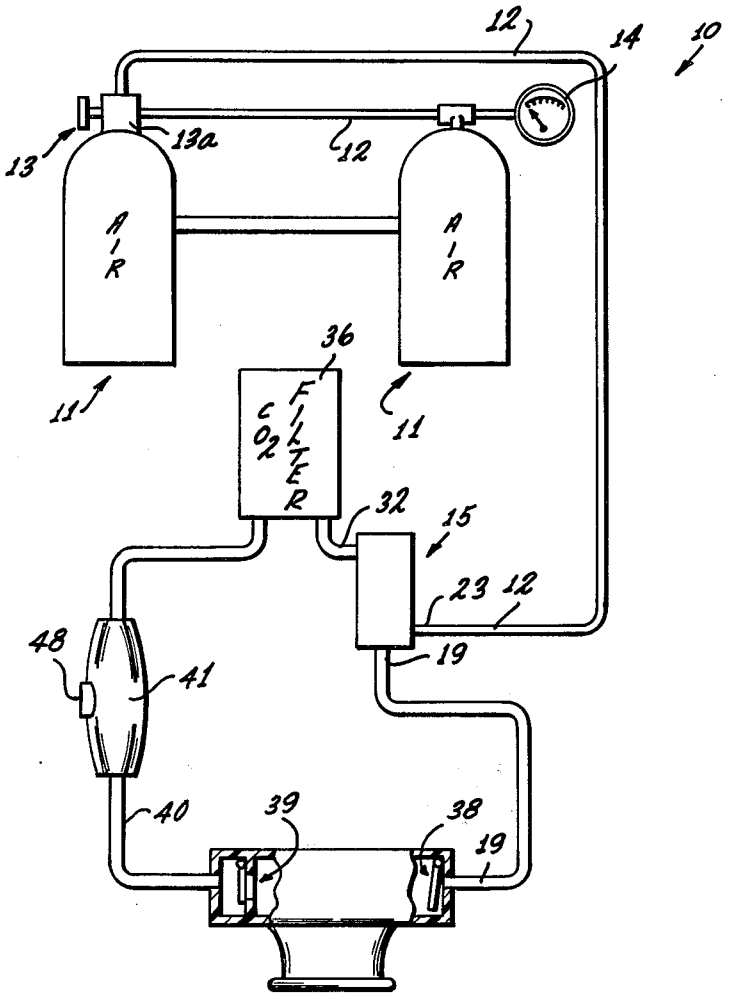
FIG. 1 is a functional schematic of a typical life support system incorporating the mixing and supply device of this invention.

Referring now to FIG. 1, the overall self contained system 10 is comprised of breathable gas storage cylinders 11, generally filled at pressures up to 2000 PSI with breathable compressed air or compressed breathable gas mixtures. This compressed gas (hereinafter sometimes referred to as "fresh" breathable gas or such) is admitted into the breathing system through tubing 12 via the manual shutoff valve 13. Though fresh breathable gas is depicted here as stored in cylinders for self contained use for underwater or surface rescue applications, the invention described is equally suited for use in systems supplied with high pressure breathables from a pump or surface supply through hoses.

Pressure gage 14 provides indication to the user of the residual fresh gas supply pressure during system use. Although FIG. 1 shows 2 storage cyclinders manifolded together by tubing 12, further discussion will refer to "fresh breathables supply" as including one or more such cylinders or reservoirs and the discussion is not affected by the bulk or mass of stored breathables.

A first stage regulator, indicated generally as 13(*a*), is integral to the system and used to reduce stored gas pressure of that inside tanks 11 to a reasonable value in the general range of 100 to 150 PSI.

Fresh gas is admitted to the mixing and supply device 15 by actuation of flow control valve 17 (FIG. 2) caused by deflection inward of diaphram 18 as the user creates a slight vacuum in chamber 16 through inhalation at breathing port 19. The inhalation vacuum created at 19 by expansion of the users lungs, is communicated to chamber 16 through inhalation passageway 20. This slight vacuum allows diaphram 18 to move inward actuating lever 17(*a*) and causing flow control valve 17 to open, allowing high pressure fresh breathable gas from the ducting 12 (ducting coupled to the flow control valve at 23) to pass through flow control valve 17 into chamber tubing 24.

When pressure gas is admitted to tubing 24, control valve 25, preferable of the poppet type, is actuated, and valve stem 26 is forced off its seat 27 by the pressure differential between the pressurant of tubing 24 and the pressure in chamber 29, which pressure adjusts to the ambient or external pressure at the outer face of diaphram 18, after the system is in use.

Figure 2:
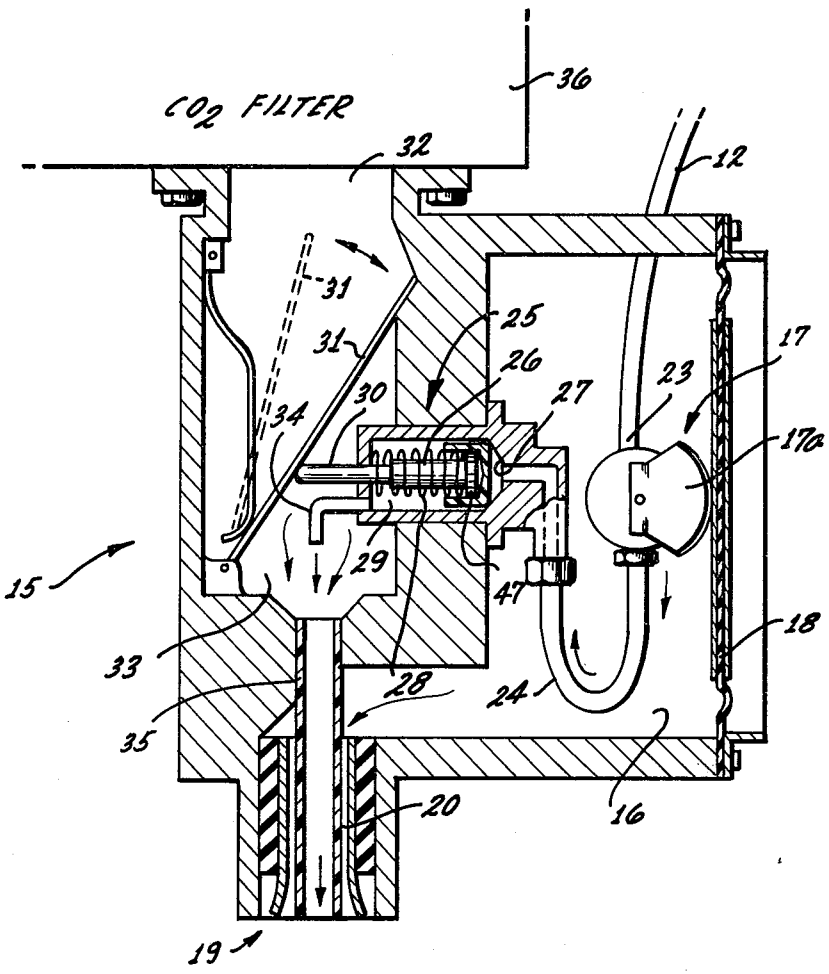
FIG. 2 is a functional schematic of the mixing and supply device of this invention.

A carbon dioxide ($CO_2$) filter/scrubber unit, shown generally as apparatus for treating exhaled gas, 36, is positioned, in FIGS. 1 and 2 at the inlet to the mixing and supply device 15 and isolated therefrom by the spring biased surface of reed valve 31.

When valve stem 26 moves off its seat 27, allowing fresh breathable gas to pass between valve seat 27 and valve head 47 into valve chamber 29, actuator 30 moves against reed valve 31, forcing valve 31 open and providing an open passageway between the $CO_2$ filter outlet 32 and mixing chamber 33. Spring 28 causes valve head 47 to reset when fresh breathable gas pressure is removed by closure of valve 17, and spring 31(*a*) closes reed valve 31. While the device referred to as a $CO_2$ filter is one used to remove $CO_2$ from exhaled gas, any type of apparatus for treating the exhaled gas by removing its harmful components will suffice, for purposes of this invention. (e.g. membrane filters, soda lime filters, etc.) Simultaneously, with movement of actuator 30, high pressure fresh breathable gas is admitted to nozzle 34 from which a high velocity stream issues and the gas present at filter outlet 32 is sucked through mixing chamber 33 by the resulting Bernoulli effect low pressure area in the space between nozzle 34 and breathing tube 35. Breathing tube 35, of course leads directly to breathing port 19 and thence to the user's lungs.

While two distinct valves 17 and 25 are shown in FIG. 2, it will be readily apparent to one skilled in the art that a single, multiple function valve could be effectively used to perform the function of these two without departing from the spirit and scope of the invention.

Design variables of this invention include diameter of jet nozzle 34, diameter and length of breathing tube 35 and physical placement of nozzle 34 with respect to the entry rim of breathing tube 35. Force of suction and mixture are critically dependent on these dimensions so that a higher suction force at the $CO_2$ filter output, resulting in greater use of rebreathed gas, can be achieved by proper choice of dimensions of these components.

In a working model of this system, approximately 75% rebreathable gas was utilized and the remaining 25% vented to the outside environment through pressure relief valve 48 of the rebreathable gas storage reservoir 41. In this model, nozzle 34 was of diameter 0.100 inches, breathing tube 35 was of 0.400 inches diameter of 2.5 inches long. Dimensional variations have been found to alter efficiency of rebreathed gas usage over a wide range and the dimensions above were found typical for the exhaled gas utilization given. This invention teaches all combinations of jets and receiver or breathing tube dimensions. The above case is for a test model only. Breathed gas in reservoir 41 is thus sucked through filter 36 by the vacuum created in mixing chamber 33. This reservoir gas, which is comprised of that previously breathed by the user and exhaled into breathed gas storage bag 41, is thus forced through the $CO_2$ scrubber/filter 32 by the vacuum in mixing chamber 33 rather than by exhalation force of the user, as is done in conventional or previously proposed systems. $CO_2$ free, previously breathed air, with oxygen content of approximately 16% is then mixed with fresh breathable gas in chamber 33 and provided to breathing port 19 of the user.

It must be appreciated that use of this invention is not limited to those systems utilizing mouthpieces to supply oxygenated breathables. Any helmet, face mask or mouth/nose type arrangement is within the scope of this invention and whenever "breathing port" is used herein, it should be understood that face masks and helmets allowing both oral and nasal inhalation/exhalation are encompasses by the wording.

Breathables leaving mixing chamber 33 pass through a "one-way" check valve 38 which opens upon inhalation of the user or upon the slight negative pressure of inhalation at breathing port 19.

When the user's lungs are filled and inhalation vacuum at breathing port passageway 19, 20 and chamber 16 disappears, diaphram 18 returns to its original position and valve 26 reseats itself at 27. Reed valve 31 closes, isolating chamber 33 from $CO_2$ filter 36 and the system is ready for exhalation by the user.

Upon slight exhalation pressure, check valve 38 closes and a similarly functioning "one way" check valve 39, connects the breathing port 19 to exhalation tubing 40 which ducts the exhaled gas through check valve 39 to exhaled gas storage bag 41. At bag 41, it passes through additional ducting to the inlet of the apparatus used in treatment of the gas for removal of its poisonous components. (generally $CO_2$)

Storage bag 41 is at the same pressure as the user's environment, it being, essentially, a flexible bladder type unit with a differential pressure relief valve, 48, designed to relieve pressure internal to the bag with it exceeds a nominal valve above the ambient pressure. A working model was used successfully with a relief pressure differential of 0.1 psi. Volume of bag 41 is not critical, but a useable model had a relief pressure capacity of approximately 2000 cc so that this volume of exhaled gas would be available for circulation through treatment apparatus 36 upon demand.

It is readily seen that for a given volume of fresh breathable gas, use of this invention provides an appreciable portion of exhaled gases (in the working model, upwards of 75% of the exhaled gas) for rebreathing by the user and his stay time in the hostile environment is greatly increased over that available with an "open circuit" system.

Where only 25% fresh breathables is required for each inhalation, the diver "stay" time is increased fourfold over that available from an "open circuit" system.

In addition to the high efficiencies described above, the within system is of proven reliability and safety, utilizing only those components normally found in standard time proven open circuit systems plus the flexible exhaled gas storage reservoir 41 and reed valve 31 with valve 31 actuating means. Ratio of rebreathable to fresh breathable gas, volume wise, is fixedly adjustable through selection of dimensions of jet 34, breathing tube 35 and geometry of mixing chamber 33. Safety and reliability of this system are its strong points while the novelty and utility of its rebreathable gas device combine to present a truly unobvious improvement over similar self contained life support systems.

Certain moderately deep water operations from oil rigs or rescue and salvage ships utilize diving helmets or suits with surface supply means such as pumps and oxygen/helium or pure oxygen systems. Salvage of these expensive gases results in appreciable savings to the contractor using them. The reuse system of this invention is directly applicable to these surface supply systems without modification. Apparatus for treating the exhaled gases may be modified for various breathable gas mixtures and it is conceivable that exotic purefiers may be developed which are not described herein, but which, are, nevertheless, encompassed generally by the claims appended and which are used, in some general way, to purefy the breathed or exhaled gases by their passage through or treatment by the same.

I claim:

1. In a breathable gas life support system of the type having a supply of breathable gas stored at high pressure with apparatus for treating exhaled gas capable of being rebreathed including breathing circuit means for recirculating a portion of exhaled gas from a breathing connection means, through a reservior for storage of the exhaled gas through a $CO_2$ filter, and return to the user, an improved device for regulating, mixing and provision of stored and treated rebreathable gas comprising:

housing means having a mixing chamber connected to said breathing circuit means between said $CO_2$ filter and said breathing connection means for treating exhaled gas whereby the breathable portion of the exhaled gas freely flows into said mixing chamber;

first valve means disposed between said mixing chamber and said breathing circuit means for treating exhaled gas with said first valve means maintained in a normally closed condition thereby preventing the breathable portion of the exhaled gas from entering the mixing chamber;

a second chamber in said housing means closed to the outside environment with diaphram means for accomplishing such closure;

second valve means connected to said high pressure breathable gas supply, normally maintained in a closed condition with the operative portion of said second valve means operatively connected to said diaphram means whereby, upon the gas pressure in said second chamber being less than the pressure of the outside environment, said diaphram means will move inwardly, into said second chamber, thereby opening said second valve means;

third valve means interconnecting said second valve means and said mixing chamber with said third valve means normally maintained in a closed position and opened by means of pressure resulting from the opening of said second valve means;

said third valve means operatively connected to said first valve means, whereby upon the opening of said second valve means, said third valve means is opened, thereby providing a free flow condition between the apparatus for treating exhaled gas and said mixing chamber;

breathing conduit means directly communicating with said mixing chamber with one end thereof terminating in said breathing connection means adapted to be maintained in connection with the respiratory system of the user;

high velocity jet means connected to said third valve means and directed into said mixing chamber and breathing conduit means, whereby, upon the opening of said third valve means, gas from said high pressure supply will exit said jet means and flow into and through said mixing chamber and said conduit means, thereby creating a reduced pressure condition in said mixing chamber resulting in the drawing of previously exhaled gas from the storage reservoir through said $CO_2$ filter and said breathing circuit means for treating exhaled gas and into said mixing chamber wherein it is mixed with gas exiting said jet means and drawn through said breathing conduit means;

and intake means for coupling said second chamber with the respiratory system of the user's inhaling through said intake means, pressure in said second chamber is reduced whereby said diaphram means moves inwardly opening said second valve means.

2. The device set forth in claim 1 wherein said first valve means comprises a spring biased surface sized to isolate said mixing chamber from the exhaled gas treatment means and hinged to said housing means whereby it moves in and out of a position either isolating or coupling said mixing chamber to the outlet of the exhaled gas treatment means.

3. The device set forth in claim 1 wherein said second valve means comprises a normally closed flow control valve having an actuating lever bearing against said diaphram means whereby movement of said diaphram means against said actuating lever opens said flow control valve.

4. The device set forth in claim 2 wherein said third valve means comprises a poppet type valve normally biased to a closed position with actuating means extending therefrom and in contact with said spring biased first valve means whereby the opening of said third valve means opens said first valve means.

5. The device set forth in claim 2 wherein said second valve means comprises a normally closed flow control valve having an actuating lever bearing against said diaphram means whereby movement of said diaphram means against said actuating lever operates said flow control valve.

6. The device set forth in claim 3 wherein said third valve means comprises a poppet type valve biased to a normally closed condition with actuating means extending therefrom and interacting with said spring biased surface of said first valve means whereby operation of said third valve means results in operation of said first valve means.

7. In a breathable gas life support equipment array having a source of fresh breathable gas maintained at a high pressure including breathing circuit means including exhaled gas treatment means for treating exhaled gas so that treated gas is capable of being rebreathed by the array user, breathing connection means whereby the array user is given access to the breathable and rebreathable gases, appropriate check valve means for providing uni-directional flow through said breathing circuit means and gas carrying tubing coupling said breathing connection means, exhaled gas treatment means and said check valve means in series, an improved rebreathable gas mixing and supply device comprising;

housing means disposed in said breathing circuit means downstream of said exhaled gas treatment means and having a mixing chamber;

first valve means disposed between said mixing chamber and said exhaled gas treatment means, said first valve means maintained in a normally closed condition;

second valve means;

a second chamber in said housing means having diaphram means, said diaphram means isolating said second chamber from the environment external to the equipment array and operatively coupled to said second valve means;

said second valve means maintained in a normally closed condition, interconnecting said mixing chamber and said fresh breathable gas supply;

said second chamber coupled to said breathing connection means by means of an inhalation passageway so that inhalation by user reduces pressure internal to said second chamber and causes diaphram means to actuate second valve means to the open condition;

means coupled between said second valve means and said first valve means to that actuation of second valve means results in opening normally closed first valve means;

jet means disposed between said mixing chamber and second valve means whereby high pressure fresh breathable gas is admitted to said jet means upon actuation of said second valve means and flows into and through said mixing chamber;

conduit means connecting said mixing chamber with said breathing connection means said conduit means being so disposed as to accept fresh breathable gas emitted by said jet means mixed with rebreathable gas pulled through said mixing chamber from said exhaled gas treatment means by means of reduced pressure in mixing chamber caused by high velocity fresh breathable gas flow, the rebreathable gas being then mixed with fresh breathable gas through convective and vortical forces caused by flow of the high velocity fresh breathable gas from jet means through said mixing chamber to said breathing connection means through said conduit means.

8. The device of claim 1 wherein the exhaled gas treatment means is configured to supply exhaled gas downstream of said high velocity jet means so that both fresh and rebreathable gas are passed through said apparatus for treating exhaled gas.

9. The device of claim 7 wherein the apparatus for treating exhaled gas is configured to supply exhaled gas downstream of said high velocity jet means so that both fresh and rebreathable gas are passed through said exhaled gas treatment means.

* * * * *